US005637037A

United States Patent [19]

Bergquist

[11] Patent Number: 5,637,037

[45] Date of Patent: Jun. 10, 1997

[54] METHOD AND GRINDING CUP FOR GRINDING BUTTONS OF A ROCK DRILLING BIT

[75] Inventor: Arne Bergquist, Sandviken, Sweden

[73] Assignee: Sandvik AB, Sandviken, Sweden

[21] Appl. No.: 264,148

[22] Filed: Jun. 22, 1994

[30] Foreign Application Priority Data

Jun. 22, 1993 [SE] Sweden ..... 9302160

[51] Int. Cl.[6] ..... B24B 55/02

[52] U.S. Cl. ..... 451/450

[58] Field of Search ..... 451/449, 450, 451/442, 448

[56] References Cited

U.S. PATENT DOCUMENTS

| | | | |
|---|---|---|---|
| 2,427,085 | 9/1947 | Allison | 451/450 |
| 2,455,597 | 12/1948 | Metzger et al. . | |
| 2,946,244 | 7/1960 | Maynard . | |
| 3,016,662 | 1/1962 | Ellis . | |
| 3,229,427 | 1/1966 | Goodhew | 451/450 |
| 3,609,931 | 10/1971 | Voorhies | 451/450 |
| 4,102,084 | 7/1978 | Bloomquist | 451/450 |
| 5,070,654 | 12/1991 | Manqvist et al. | 451/449 |

FOREIGN PATENT DOCUMENTS

| | | |
|---|---|---|
| 460584 | 10/1989 | Sweden . |
| 696198 | 8/1953 | United Kingdom . |
| 2008997 | 6/1979 | United Kingdom . |
| 2075876 | 11/1981 | United Kingdom . |

*Primary Examiner*—Robert C. Watson
*Assistant Examiner*—Thomas W. Lynch
*Attorney, Agent, or Firm*—Burns, Doane, Swecker & Mathis, L.L.P.

[57] ABSTRACT

The present invention relates to a method for supplying cooling medium to a grinding cup for grinding buttons of a rock drilling bit. The invention also relates to a grinding cup to carry out the method. A shank of the grinding cup is rotatably mounted in a grinding machine. In prior art grinding cups, the cooling medium is supplied via an axial bore extending through the entire grinding cup. These prior arrangements require the cooling medium to be guided through the grinding machine. The method according to the present invention supplies cooling medium to the portion of the grinding cup that is located axially between a recess of a wear part and the free end of the shank of the grinding cup.

25 Claims, 3 Drawing Sheets

METHOD AND GRINDING CUP FOR GRINDING BUTTONS OF A ROCK DRILLING BIT

BACKGROUND AND SUMMARY OF THE PRESENT INVENTION

1. Technical Field

The present invention relates to a method for supplying cooling medium to a grinding cup for grinding buttons of a rock drilling bit. The grinding cup includes a shank that is rotatably mounted in a grinding machine and a wear part having a recess. The recess carries out the grinding of the buttons. The invention also relates to a grinding cup that is intended to be rotatably mounted in a grinding machine. The grinding cup carries out grinding of buttons of a rock drilling bit. The grinding cup includes a shank and a wear part, with the wear part having a recess. The grinding cap is supplied with a cooling medium.

2. Prior Art Background

When grinding cemented carbide buttons of a drill bit, a grinding cup of the type described above is normally used. The wear part of such a grinding cup usually has an abrasive grinding surface that often includes granular diamond. However, the grinding of cemented carbide buttons generates both heat and abrasive cuttings to such an extent that it is necessary to cool the grinding cup and the button bit as well as flushing away the cuttings. The known prior art technique for such cooling is to supply cooling medium, normally water, through the grinding machine and axially through the grinding cup to provide the cooling medium to be discharged in the region where the wear part of the grinding cup engages the free end of the button. This arrangement requires that the cooling medium must be guided through the grinding machine to the rear end of a shank of the grinding cup and then axially through the shank of the grinding cup to the free end of the wear part. It is recognized that the provision of means for achieving such a cooling medium supply is a restriction from a designing point of view, i.e., when designing the grinding machine a lot of attention must be paid to the guiding of cooling medium through the grinding machine and consequently the machine may become relatively complicated.

SUMMARY OF THE INVENTION

The present invention relates to an improved method for supplying cooling medium to a grinding cup. The grinding cup is designed so that the cooling medium is not supplied via the rear end of the shank, i.e., via the grinding machine. Instead, the cooling medium is supplied to the grinding cup without entering the grinding machine. The present invention is realized by a method for supplying cooling medium to a grinding cup and a grinding cup that has been given the characteristics to accomplish that method.

BRIEF DESCRIPTION OF THE DRAWINGS

The present invention will be described with reference to the accompanying drawings wherein three embodiments of a grinding cup according to the present invention are illustrated, and wherein like members bear like reference numerals, and wherein.

DETAILED DESCRIPTION OF THE PREFERRED EMBODIMENT

Figure 1:
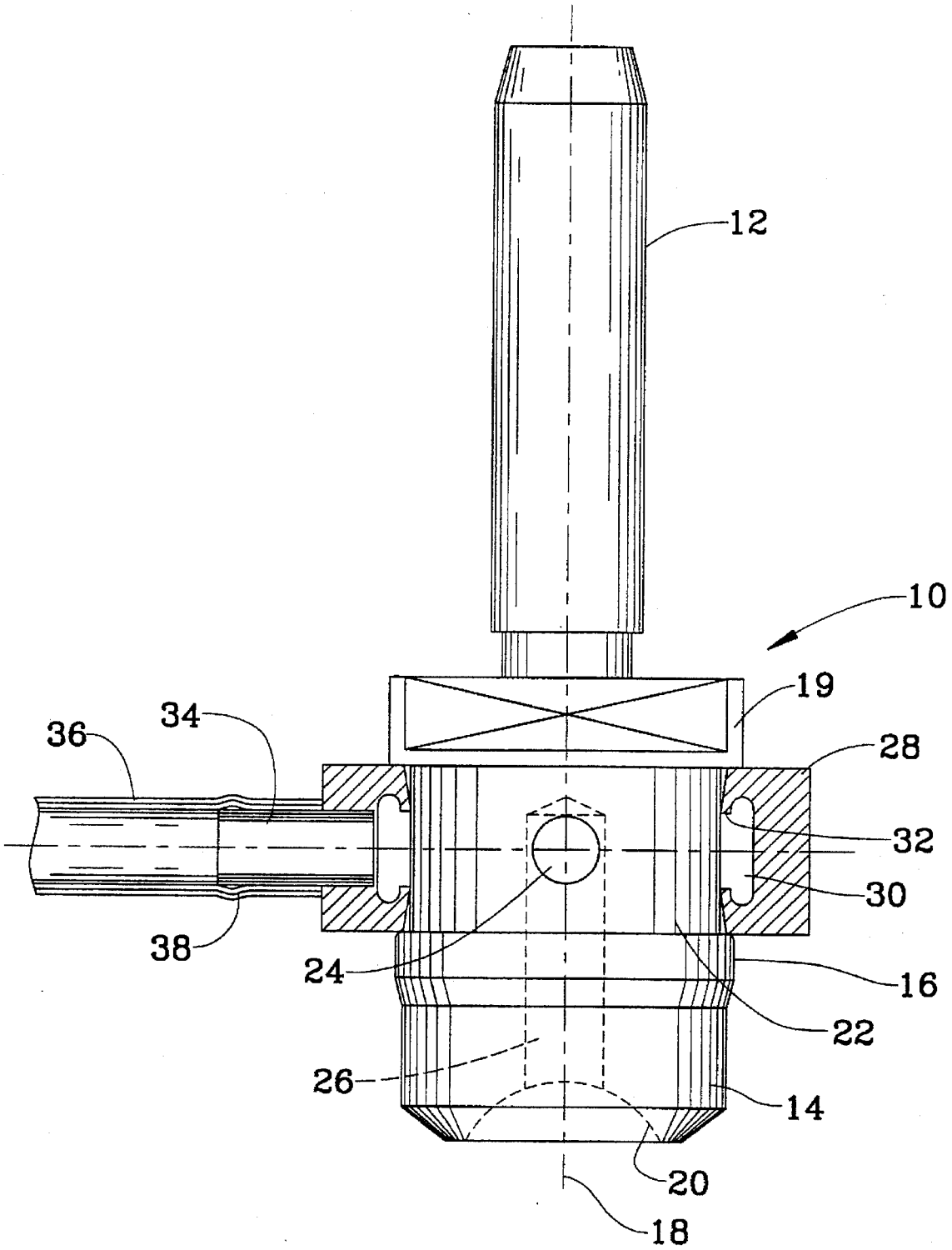
FIG. 1 is a partial cross-sectioned side view of a first embodiment of the grinding cup according to the present invention.

A grinding cup 10 according to FIG. 1 includes a shank 12, a wear part 14 and an intermediate portion 16 that bridges the shank 12 and the wear part 14. Preferably the shank 12 and the intermediate portion 16 are in one piece. The wear part 14 is connected to the intermediate portion 16 in a suitable way, preferably by brazing. However, within the present invention it is also possible that the wear part 14 is integral with the intermediate portion 16. The grinding cup 10 is rotationally symmetrical relative to its longitudinal central axis 18.

The free end of the wear part 14 has a recess 20 in the shape of a segment of a sphere when the buttons have an hemispherical free end. However, if the buttons have ballistic or conical free ends, then the recess has a complementary shape. The recess 20 is intended to engage and cooperate with the free end of a button that is to be subjected to grinding. The button is preferably made out of cemented carbide and the recess 20 is equipped with an abrasive material, preferably diamond, that can be in the shape of a matrix. If the wear part 14 is integral with the intermediate portion 16, i.e., the wear part blank is made out of steel, the diamond layers may be adhered to the inner walls of the recess of the wear part blank by electro-plating or in some other suitable known method.

At an upper end of the intermediate portion 16 of the grinding cup 10, a key handle 19 is provided that cooperates with driving means of the grinding machine (not shown) to rotate the grinding cup 10. The intermediate portion 16 is further provided with a circumferential external groove 22 that has a certain extension in axial direction of the grinding cup 10. Preferably the depth of the external groove 22 is constant. At least one hole or bore 24, having radial direction, extends between the bottom of the external groove 22 and the region of the longitudinal central axis 18. A second hole or bore 26, having a primarily axial direction, extends between the area of the inner end of the first hole 24 and the bottom of the recess 20. The first and second bores 24, 26 communicate with each other in the area of their inner ends.

A ring 28 of flexible material, e.g., plastic or rubber, is mounted in the circumferential external groove 22. The height of the ring 28 is somewhat smaller than or essentially equal to the height of the groove 22. The inner periphery of the ring 28 is provided with a circumferential internal groove 30. In the area of contact between the bottom of the external groove 22 and the inner periphery of the ring 28, the ring 28 is preferably provided with oppositely directed tongues 32 that in an active state perform a sealing action against the bottom of the external groove 22. In its mounted position, the ring 28 covers the opening of the hole 24.

The internal dimensions and tolerances of the groove 22 and the ring 28 must of course be adapted to each other in such a way that when the grinding cup 10 is rotated while the ring 28 is maintained stationary, a proper sealing between the ring 28 and the groove 22 is carried out simultaneously as the friction between the ring 28 and the groove 22 is kept at a proper level.

The ring 28 is also provided with a pipe 34 that extends in a radial direction of the grinding cup 10. The pipe 34 extends through the wall of the ring 28. The pipe 34 is connected to the ring 28 in a substantially leak tight manner, preferably by vulcanization. The pipe 34 extends beyond the outer periphery of the ring 28 to a certain extent in order to be able to receive a hose 36, that is pushed onto the pipe 34. Preferably the pipe 34 is provided with a bulge 38 to achieve a better securing of the hose 36 on the pipe 34.

The described grinding cup 10 functions in the following way. The shaft 12 of the grinding cup 10 is mounted in the rotatable spindle of a grinding machine (not shown). The grinding cup is then adjusted in position relative to the button that is to be ground, i.e., a position where the recess in the wear part 14 engages the button. The grinding cup 10 is then rotated to perform grinding of the button. When the grinding cup 10 rotates the ring 28 remains stationary, Thus, it is important that the dimensions and mutual tolerances of the groove 22 and the ring 28 are such that the intermediate portion 16 can easily rotate relative to the ring 28, while the supply of cooling medium can still be effected through the groove 22, the hole 24 and the hole 26 to the recess 20. Due to the flexibility of the ring 28, it is possible to mount the ring 28 in the groove 22 by pushing the ring 28 over the wear part 14 into the groove 22. The tongues 32 will deflect to allow such pushing of the ring 28 over the wear part 14.

From an external source, cooling medium is supplied to the recess 20 via the hose 36, the pipe 34, the groove 30, the first hole 24 and the second hole 26. When the space defined by the bottom of the groove 22 and the groove 30 is pressurized by the cooling medium then the tongues 32 of the ring 28 seal against the bottom of the groove 22 and simultaneously the side walls of the ring 28 are supported by the side walls of the groove 22. However, there is no definite requirement that this sealing is total. If there is a certain leakage of cooling medium between the tongues 32 of the ring 28 and the bottom of the groove 22, the cooling medium will likely flow downwards and cool the outside of the wear part 14. Such a cooling is normally favorable in the grinding action. However, the dominating part of the cooling medium should be supplied via the holes 24 and 26 to the recess 20.

Preferably the length of the life of the ring 28 is substantially the same as the length of the life of the rest of the grinding cup 10.

Figure 2:
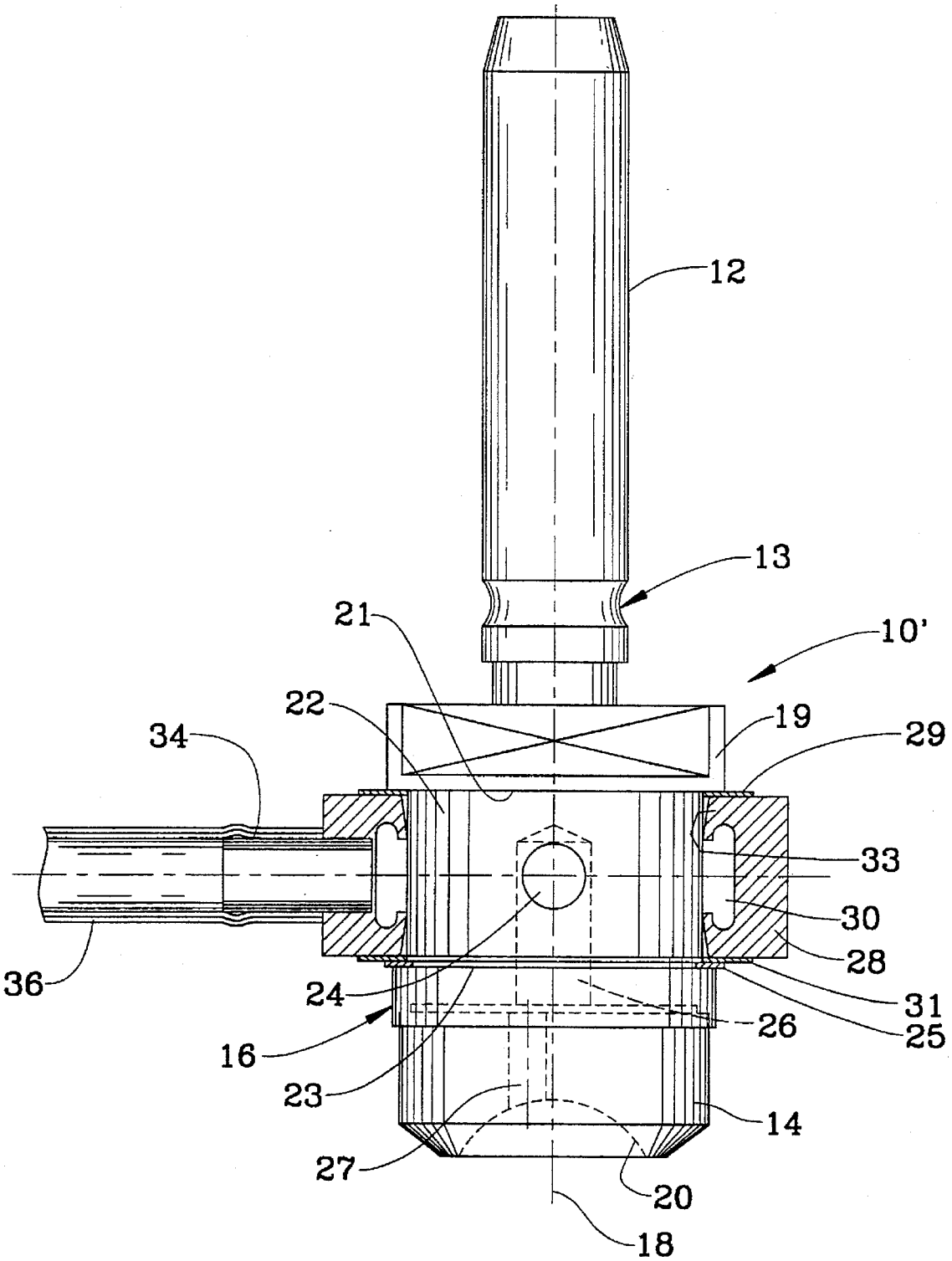
FIG. 2 is a partial cross-sectioned side view of a second embodiment of the grinding cup according to the present invention.

In the embodiment according to FIG. 2, the grinding cup 10' includes a shank 12, a wear part 14 and an intermediate portion 16 that is integrally connected with both the shank 12 and the wear part 14. The shank 12 is provided with a groove 13 that is intended to receive an O-ring that yieldably secures the shank 12 when mounted in the grinding machine. Preferably, the shank 12 and the intermediate portion 16 are in one piece. The wear part 14 is connected to the intermediate portion 16 in a suitable way, preferably by brazing. However, within the present invention it is also possible that the wear part 14 is integral with the intermediate portion 16. The grinding cup 10' is rotationally symmetrical relative to its longitudinal central axis 18.

The free end of the wear part 14 has a recess 20 in the shape of a segment of a sphere. As explained in connection with the embodiment according to FIG. 1, the shape of the recess can vary depending on the shape of the free end of the button. The recess 20 is intended to engage and cooperate with the free end of a button that is subjected to grinding. The button is preferably made out of cemented carbide and the recess 20 is provided with an abrasive material, preferably diamond that can be in the shape of a matrix, and may be electroplated to a steel body or in some other suitable way adhered to the steel body of the wear part 14.

In its upper portion, the intermediate portion 16 of the grinding cup 10' is provided with a key handle 19 that cooperates with driving means of the grinding machine to rotate the grinding cup 10'. The intermediate portion 16 of the grinding cup 10' is further provided with a circumferential external flange 21 that separates the key handle 19 from a sub portion 22 of the intermediate portion 16, the key handle 19 and the sub-portion 22 having different diameters. The sub-portion 22 has a smaller diameter and a certain extension in the axial direction of the grinding cup 10' and the extension being defined by a circumferential slot 23. Preferably, the external diameter of the sub-portion 22 is constant. At least one hole 24, having a radial direction, extends between the periphery of the sub-portion 22 and the region of the longitudinal central axis 18. A second hole 26, having at least a primarily axial direction, extends between the area of the inner end of the first hole 24 and about halfway to the bottom of the recess 20. The first and second holes 24, 26 are connected with each other in the area of their inner ends.

A third hole 27 extends from the region of the outer end of the second hole 26. The third hole 27 ends in the recess 20. As can be seen in FIG. 2, the third hole 27 is displaced in a radial direction relative to the second hole 26 although the second and third holes or bores 26, 27 are communicating with each other. With this arrangement the third hole 27 will open eccentrically in the recess 20 relative to the central axis 18. In this connection it should be pointed out that the design and orientation of especially the third hole 27 can vary within the scope of the present invention. It is, knowing that the cooling fluid opening, in this case the third hole emerges in the recess 20 via a slot having a length substantially equal to the diameter of the recess 20.

In the circumferential sub-portion 22 a first washer 29, a ring 28 of flexible material, e.g., plastic or rubber, and a second washer 31 are mounted in consecutive order. The first washer 29 is in close contact with the flange 21. The total height of the first washer 29, the ring 28 and the second washer 31 is somewhat smaller than the axial extension of the sub-portion 22. In the slot 23, a locking ring 25 is mounted to secure the first washer 29, the ring 28 and the second washer 31 in the axial direction. The inner periphery of the ring 28 is provided with a circumferential internal groove 30. In its mounted position, the ring 28 covers the opening of the hole 24. It is important that the tolerances of the cooperating dimensions of the ring 28 and the sub-portion 22 are adapted to each other, i.e., the internal diameter of the ring 28 and the external diameter of the sub-portion 22. The sub-portion 22 must rotate relatively easily relative to the ring 28 and still there must be sufficient proper sealing action between the ring 28 and the sub-portion 22 to guide cooling medium to the recess 20 via the holes 24, 26, 27.

The ring 28 is also provided with a pipe 34 that extends in the radial direction of the grinding cup 10'. The pipe 34 extends through the wall of the ring 28. The pipe 34 is connected to the ring 28 preferably by vulcanization. The pipe 34 extends beyond the outer periphery of the ring 28 to a certain extent in order to be able to receive a hose 36, that is pushed onto the pipe 34. Preferably the pipe 34 can be provided with a bulge to achieve a better securing of the hose 36 on the pipe 34.

The grinding cup 10' according to FIG. 2 functions principally in the same way as the grinding cup 10 according to FIG. 1. However, the ring 28 is of slightly different design. When the space between the sub-portion 22 and the groove 30 is pressurized by cooling medium, the remaining portions 33 of the inner periphery of the ring 28 are urged apart in opposite directions to provide a sealing against the first and second washers 29, 31. The first washer 29 is in its turn urged against the flange 21 to provide a sealing against the cooling medium and the second washer 31 is urged against the locking ring 25 to provide a corresponding sealing. However, what has been said in connection with the embodiment according to FIG. 1 concerning leakage of cooling medium that cools the outside of the wear part 14 applies also for the embodiment according to FIG. 2.

Figure 3:
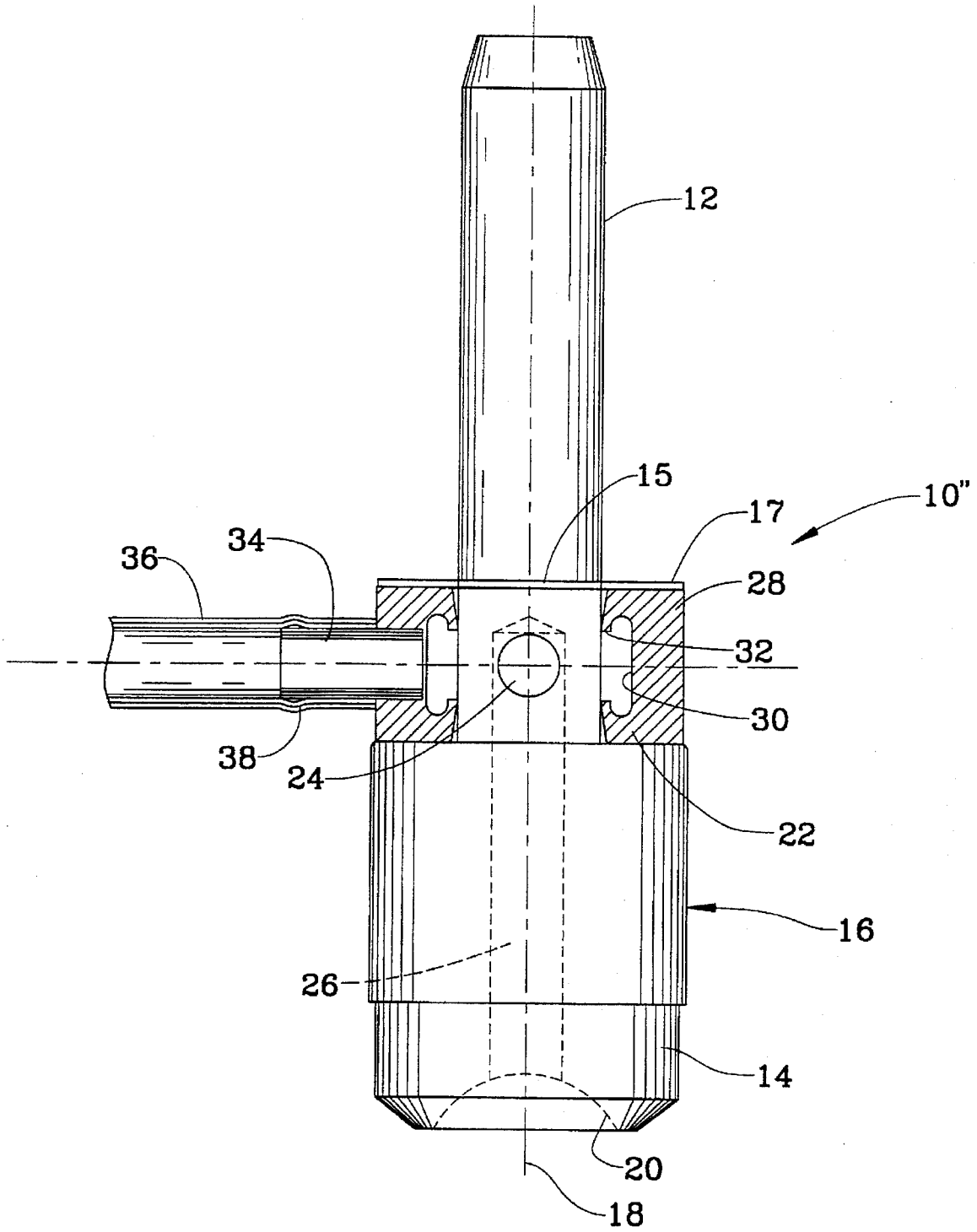
FIG. 3 is a partial cross-sectional view of a third embodiment of the grinding cup according to the present invention.

The grinding cup 10" according to FIG. 3 includes a shank 12, a wear part 14 and an intermediate portion 16 that bridges the shank 12 and the wear part 14. Preferably the shank 12 and the intermediate portion 16 are in one piece. The wear part 14 is connected to the intermediate portion 16 in a suitable way, preferably by brazing. However, within the present invention it is also possible that the wear part 14 be integral with the intermediate portion 16. The grinding cup 10" is rotationally symmetrical relative to its longitudinal central axis 18.

The free end of the wear part 14 has a recess 20 in the shape of a segment of a sphere when the buttons have a hemispherical free end. However, if the buttons have ballistic or conical free ends, then the recess has a complementary shape. The recess 20 is intended to engage and cooperate with a free end of a button that is subjected to grinding. The button is preferably made out of cemented carbide and the interior surface of the recess 20 is provided with an abrasive material, preferably diamond that can be in the shape of a matrix. If the wear part 14 is integral with the intermediate portion 16, i.e., the wear part blank is made out of steel, a diamond layer can be suitably electro-plated or adhered in some other suitable way to the wear part blank.

In its lower part the shank 12 is provided with at least one hole 24, having a radial extension between the periphery of the shank 12 and the region of the longitudinal central axis 18. A second hole 26, having a primarily axial direction, extends between the area of the inner end of the first hole 24 and the bottom of the recess 20. The first and second holes 24, 26 communicate with each other in the area of their ends.

On the shank 12, a ring 28 of flexible material, e.g., plastic or rubber, is mounted. The lower side of the ring 28 contacts the upper side of the intermediate portion 16. The height of the ring 28 is somewhat smaller or substantially the same as the axial distance between the upper side of the intermediate portion 16 and a groove 15 that receives a snap ring 17 to lock the ring 28 in axial direction. The inner periphery of the ring 28 is provided with a circumferential internal groove 30. In the area of contact between the shank 12 and the inner periphery of the ring 28, the ring 28 is provided with opposite tongues 32 that in an active state perform a sealing action against the shank 12. In its mounted position, the ring 28 covers the opening of the hole 24. Concerning the internal dimensions and tolerances between the ring 28 and the supporting surfaces reference is made to what has been stated above in connection with the embodiments according to FIGS. 1 and 2.

Within the scope of the present invention it is also possible that there is no groove in the shank 12 but the ring 28 is locked axially by an O-ring that is pushed onto the shank 12.

The ring 28 is also provided with a pipe 34 that extends in a radial direction of the grinding cup 10." The pipe 34 extends through the wall of the ring 28, with the pipe 34 being connected to the ring 28 preferably by vulcanization. The pipe 34 extends beyond the outer periphery of the ring 28 to a certain extent in order to be able to receive a hose 36, that is pushed onto the pipe 34. Preferably, the pipe 34 is provided with a bulge 38 to achieve a better securing of the hose 36 on the pipe 34.

The grinding cup 10" according to FIG. 3 functions principally in the same way as the grinding cup 10 according to FIG. 1 or the grinding cup 10' of FIG. 2. However, since the grinding cup 10" is not provided with a key handle the rotational driving of the grinding cup 10" is preferably carried out by having a chuck of the grinding machine to clamp the shank 12 to such an extent that rotational driving of the grinding cup 10" can be carried out. Within the scope of the present invention it is also possible to design the upper part of the shank 12 with a noncircular cross-section, e.g., a square cross-section with the cross-section engaging rotational driving means of the grinding machine. Since the ring 28 is of principally the same design for the embodiments of FIGS. 1 and 3, the sealing by the tongues 32 is carded out in a corresponding way. What has been said in connection with the embodiment according to FIG. 1 concerning leakage of cooling medium that cools the outside of the wear part 14 applies also for the embodiment according to FIG. 3.

Common for the described embodiments is that no axial boring through the shank need to be provided and also that the grinding machines will have an essentially simplified designed since no cooling medium supply, e.g., in the shape of borings and sealings, through the grinding machine is necessary. This means that the degree of freedom when designing grinding machines is substantially increased.

The principles, preferred embodiments, and mode of operation of the present invention have been described. However, the scope of protection sought is not limited to the particular embodiments disclosed, but is defined by the claims attached hereto.

What is claimed is:

1. A method for grinding buttons of a rock drilling bit while supplying cooling medium to a grinding cup for grinding the buttons, said grinding cup including a shank that is rotatably mounted in a grinding machine and a wear part having a recess, the method comprising the steps of grinding the buttons with an interior surface of the recess, supplying cooling medium substantially radially to a portion of the grinding cup that is located axially between the recess and a free end of the shank, and delivering the cooling medium to the interior surface of the recess, wherein the cooling medium is supplied to the grinding cup through a circumferential ring and further comprising the step of sealing the ring relative to the grinding cup.

2. The method according to claim 1, wherein the cooling medium is supplied to an intermediate portion of the grinding cup, said intermediate portion being located axially between the shank and the wear part of the grinding cup.

3. The method according to claim 1, wherein the cooling medium is supplied to a portion of the wear part adjacent an end of the shank of the grinding cup directed towards the wear part.

4. The method according to claim 1, further comprising the step of supplying the cooling medium from an interior of the ring axially through the grinding cup to the interior surface of the recess.

5. The method according to claim 1, wherein the circumferential ring is formed of flexible material, an inner periphery of said circumferential ring being provided with a circumferential internal groove.

6. The method according to claim 1, further comprising a step of replacing the circumferential ring along with the grinding cup.

7. The method according to claim 1, wherein the circumferential ring is formed of a flexible material and the step of sealing the ring relative to the grinding cup is performed as a function of the flexibility of the circumferential ring.

8. Grinding cup that is intended to be mounted in a grinding machine, said grinding cup carrying out grinding of buttons of a rock drilling bit, said grinding cup comprising a shank and a wear part, said wear part having a recess shaped to receive and grind the buttons, a portion of the grinding cup located axially between the recess and a free end of the shank being provided with means for transferring cooling medium from an outside source to the recess of the wear part, wherein the means for transferring cooling medium includes a circumferential ring and the cooling medium is transferred through the circumferential ring.

9. The grinding cup according to claim 8, wherein the portion of the grinding cup located axially between the recess and the free end of the shank is an intermediate portion located between the shank and the wear part.

10. The grinding cup according to claim 8, wherein the portion of the grinding cup located axially between the recess and the free end of the shank is a portion of the wear part adjacent an end of the shank directed towards the wear part.

11. The grinding cup according to claim 8, wherein the circumferential ring is formed of flexible material, an inner periphery of said circumferential ring being provided with a circumferential internal groove.

12. The grinding cup according to claim 11, wherein the ring is provided with means for connection to a cooling medium source, said means transferring cooling medium to the internal groove of the ring.

13. The grinding cup according to claim 11, wherein a space provided between the internal groove of the ring and the grinding cup communicates with the recess of the wear part.

14. The grinding cup according to claim 11, wherein the ring includes two circumferential tongues on a radially inside surface that contact an outer portion of the grinding cup.

15. The grinding cup according to claim 11, wherein the circumferential ring is received in a circumferential groove in the grinding cup.

16. The grinding cup according to claim 8, wherein the means for transferring the cooling medium to the recess includes both a radial and an axial bore.

17. The grinding cup according to claim 16, wherein the radial bore extends inwardly from a circumferential groove in the grinding cup.

18. The grinding cup according to claim 16, wherein the recess is of a concave cup shape and the axial bore opens into the recess radially displaced from a rotational axis of the grinding cup.

19. Grinding cup for grinding buttons of a rock drilling bit, said grinding cup comprising a shank and a wear part, said wear part having a recess for receiving and grinding the buttons, an intermediate portion of the grinding cup located axially between the recess and a free end of the shank, the intermediate portion having an outer peripheral surface, the outer peripheral surface of the intermediate portion provided with a circumferential groove, means for transferring cooling medium from an outside source to the circumferential groove, and connecting means for transferring the cooling medium from the circumferential groove to the recess of the wear part.

20. The grinding cup according to claim 19, wherein the means for transferring cooling medium from an outside source to the circumferential groove includes a circumferential ring.

21. The grinding cup according to claim 20, wherein the circumferential ring is formed of a flexible material, an inner periphery of the circumferential ring being provided with a circumferential internal groove.

22. The grinding cup according to claim 19, wherein the circumferential groove forms a seat for the circumferential ring.

23. A grinding apparatus for grinding buttons of a rock drilling bit comprising:

a grinding machine;

a grinding cup removably attached to the grinding machine, the grinding cup having a shank and a wear part, said wear part having a recess configured for receiving and grinding the buttons, an intermediate portion of the grinding cup located axially between the recess and a free end of the shank being provided with means for transferring cooling medium from an outside of the intermediate portion to the recess of the wear part; and a delivery means for delivering the cooling medium from an outside source to the outside of the intermediate portion, the delivery means being connected to the intermediate portion only and displaced from the grinding machine.

24. The grinding apparatus of claim 23, wherein the delivery means is a circumferential ring of flexible material which forms a seal around a part of the intermediate portion.

25. The grinding apparatus of claim 24, wherein the circumferential ring is placed in a circumferential groove formed in the intermediate portion.

* * * * *